US011764051B2

(12) United States Patent
Rellergert et al.

(10) Patent No.: US 11,764,051 B2
(45) Date of Patent: Sep. 19, 2023

(54) LINEAR QUADRUPOLE ION TRAP MASS ANALYZER

(71) Applicants: Georgia Tech Research Corporation, Atlanta, GA (US); Wade Rellergert, Atlanta, GA (US); Robert Clark, Atlanta, GA (US); Harley Hayden, Atlanta, GA (US); Brian Sawyer, Atlanta, GA (US)

(72) Inventors: Wade Rellergert, Atlanta, GA (US); Robert Clark, Atlanta, GA (US); Harley Hayden, Atlanta, GA (US); Brian Sawyer, Atlanta, GA (US)

(73) Assignee: Georgia Tech Research Corporation, Atlanta, GA (US)

( * ) Notice: Subject to any disclaimer, the term of this patent is extended or adjusted under 35 U.S.C. 154(b) by 120 days.

(21) Appl. No.: 17/600,731

(22) PCT Filed: Apr. 1, 2020

(86) PCT No.: PCT/US2020/026190
§ 371 (c)(1),
(2) Date: Oct. 1, 2021

(87) PCT Pub. No.: WO2020/205982
PCT Pub. Date: Oct. 8, 2020

(65) Prior Publication Data

US 2022/0199393 A1 Jun. 23, 2022

Related U.S. Application Data

(60) Provisional application No. 62/828,171, filed on Apr. 2, 2019.

(51) Int. Cl.
*H01J 49/42* (2006.01)
*H01J 49/00* (2006.01)

(52) U.S. Cl.
CPC ..... *H01J 49/4225* (2013.01); *H01J 49/0018* (2013.01); *H01J 49/423* (2013.01)

(58) Field of Classification Search
CPC ..... H01J 49/4225; H01J 49/0018
(Continued)

(56) References Cited

U.S. PATENT DOCUMENTS 6,838,666 B2 1/2005 Ouyang et al.
7,411,187 B2 8/2008 Monroe et al.
(Continued)

FOREIGN PATENT DOCUMENTS

CA 2513067 7/2004

OTHER PUBLICATIONS

Bronnutt et al.: "Monolithic microfabricated ion trap chip design for scaleable quantum processors"; New Journal of Physics; 2006.
(Continued)

*Primary Examiner* — Nicole M Ippolito
(74) *Attorney, Agent, or Firm* — Bryan W. Bockhop; Bockhop Intellectual Property Law, LLC

(57) ABSTRACT

An ion trap (100) includes a first electrode pair (110) and a second electrode pair (130), each including a first conductive member (112) and a second conductive member (120) and facing each other so that the first conductive member (112) of the first electrode pair (110) is on a common plane with the second conductive member (120) of the second electrode pair (130) and so that the second conductive member (120) of the first electrode pair (110) is on a common plane with the first conductive member (112) of the second electrode pair (130), a gap (132) therebetween. A signal generator (210) generates a periodic signal (212) applied to the first conductive members (112). A phase shifter (216) generates a second periodic signal (218) that is
(Continued)

180 out of phase therewith applied to the second conductive members (120). Ions are trapped by a resulting electric field.

20 Claims, 5 Drawing Sheets

(58) Field of Classification Search
USPC ..... 250/281, 282, 283
See application file for complete search history.

(56) References Cited

U.S. PATENT DOCUMENTS

| | | | | |
|---|---|---|---|---|
| 8,878,127 | B2 | 11/2014 | Ramsey et al. | |
| 2007/0040113 | A1 | 2/2007 | Monroe et al. | |
| 2009/0026367 | A1 | 1/2009 | Cheung et al. | |
| 2012/0305758 | A1* | 12/2012 | Park ..... | H01J 49/421 250/288 |

OTHER PUBLICATIONS

Decker et al.: "A Microscale Planar Linear Ion Trap Mass Spectrometer"; J. Am. Soc. Mass Spectrom.; Dec. 12, 2018.

Cheung et al.: "Chip-Scale Quadrupole Mass Filters for Portable Mass Spectrometry"; Journal of Microelectromechanical Systems; vol. 19, No. 3; Apr. 26, 2010.

Gang et al.: "Optimization and simulation of MEMS rectilinear ion trap"; AIP Advances; Nov. 24, 2014.

Wilpers et al.: "A monolithic array of three-dimensional ion traps fabricated with conventional semiconductor technology"; (Abstract only); Nature Nanotechnology; Jul. 22, 2012.

Hunsen et al.: "A Lithographically Patterned Discrete Planar Electrode Linear Ion Trap Mass Spectrometer"; (Abstract only); Journal of Microelectromechanical Systems, vol. 22, No. 4, pp. 876-883, Aug. 2013.

Jiang et al.: "Printed Circuit Board Ion Trap Mass Analyzer: its Structure and Performance"; (Abstract only); Analytical Chemistry 85(12); Jun. 5, 2013.

Syms et al.: "MEMS mass spectrometers: the next wave of miniaturization"; (Abstract only); Journal of Micromechanics and Microengineering, vol. 26, No. 2; Jan. 8, 2016.

"Supplementary European Search Report"; EPO search report in related European case Serial No. EP 20 78 4614; dated Nov. 29, 2022.

* cited by examiner

LINEAR QUADRUPOLE ION TRAP MASS ANALYZER

CROSS-REFERENCE TO RELATED APPLICATION(S)

This application claims the benefit of U.S. Provisional Patent Application Ser. No. 62/828,171, filed Apr. 2, 2019, the entirety of which is hereby incorporated herein by reference.

BACKGROUND OF THE INVENTION

1. Field of the Invention

The present invention relates to mass analyzers and, more specifically to a mass analyzer that employs a quadrupole ion trap.

2. Description of the Related Art

Mass spectrometers allow for the determination of the chemical constituents in a sample, and as such they have wide ranging applications in the modern world. For example, mass spectrometers can be used to detect specific types of gasses and other chemical compounds. Effective portable mass spectrometers could be used in a wide variety of applications, including chemical weapons detection, pollutant detection, environmental applications and quality assurance. Unfortunately, many portable mass spectrometers, because of their bulk and power requirements, cannot practically be mounted on a small vehicle or worn by a person. A chip-scale mass spectrometer would enable that, as well as networked arrays of fieldable mass spectrometers.

A typical mass spectrometer consists of several subsystems, including: an ion source, a mass analyzer, an ion detector, vacuum system/pumps, and various electronic circuits). Each of these items would need to be miniaturized to produce a working chip-scale mass spectrometer. However, the mass analyzer is the heart of a mass spectrometer, and ultimately determines the instrument's overall ability to discern the constituents of a material under analysis. While attempts have been made at fabricating chip scale mass analyzers, their performance characteristics are not yet at a level where they can provide useful mass analysis in many portable applications.

Existing portable systems require a large power draw (e.g., 50 W), are expensive, require complicated maintenance and must be operated by expert users.

An important requirement for working portable mass spectrometers is that they include effective vacuum pumps. Microfabrication of such devices can be quite challenging. However, chip-scale ion trap mass analyzers would be able to operate effectively up to about 1 Torr, which would reduce the requirements of the currently large and power hungry vacuum pumps associated with larger mass analyzers.

Therefore, there is a need for a chip scale mass analyzer having a geometry that allows for microfabrication.

SUMMARY OF THE INVENTION

The disadvantages of the prior art are overcome by the present invention which, in one aspect, is an ion trap that includes a first electrode pair and a second electrode pair. Each electrode pair includes a first conductive member and a second conductive member. The first electrode pair faces the second electrode pair so that the first conductive member of the first electrode pair is on a first common plane with the second conductive member of the second electrode pair, and so that the second conductive member of the first electrode pair is on a second common plane with the first conductive member of the second electrode pair. The first common plane is spaced apart from and parallel to the second common plane. The first electrode pair is spaced apart from the second electrode pair so as to define a gap therebetween. A signal generator is configured to generate a first periodic signal and to apply the first periodic signal to the first conductive member of the first electrode pair and the first conductive member of the second electrode pair. A phase shifter is electrically coupled to the signal generator and is configured to generate a second periodic signal that is out of phase by a predetermined phase shift with the first periodic signal and to apply the second periodic signal to the second conductive member of the first electrode pair and the second conductive member of the second electrode pair, wherein ions of a predetermined type that are introduced into the gap are trapped by a resulting electric field. The ion trap has relative dimensions including: a space in a range of 6.0 units to 8.2 units defined between the first conductive member of the first electrode pair and the second conductive member of the first electrode pair; a space in a range of 6.0 units to 8.2 units defined between the first conductive member of the second electrode pair and the second conductive member of the second electrode pair; and the first electrode pair is spaced apart from the second electrode pair so as to define a space therebetween of about 10 units. Ions escaping through the gap have an ion mass and an ion charge and the signal generator is configured to generate the first periodic signal so as to have an RF drive frequency and an RF voltage amplitude determined by:

$$\frac{2V}{\left(\frac{m}{Z}\right)r^2\Omega^2} = 0.9$$

wherein:

m is the ion mass;

z is the ion charge;

r is an effective trap radius, which is approximately one half of the space between the first electrode pair and the second electrode pair; Omega ($\Omega$)=2*$\pi$*f, where f is the RF drive frequency; and V is the applied RF voltage amplitude. This is the voltage at which an ion of mass m and charge z is ejected from the trap. Values of voltage below this allow the ion to be stably trapped.

In another aspect, the invention is a quadrupole ion trap mass analyzer that includes an ion source and an ion trap. The ion trap that includes: a first electrode pair and a second electrode pair. Each electrode pair includes: a first conductive member including a first conductive surface; a second conductive member including a second conductive surface. The first electrode pair faces the second electrode pair so that the first conductive surface of the first electrode pair is on a first common plane with the second conductive surface of the second electrode pair and so that the second conductive surface of the first electrode pair is on a second common plane with the first conductive surface of the second electrode pair. The first common plane is spaced apart from and parallel with the second common plane. The first electrode pair is spaced apart from the second electrode pair so as to define a gap therebetween. A signal generator is configured to generate a first periodic radio frequency signal that is biased by an alterable bias signal and is configured to apply the first periodic signal to the first conductive surface of the first electrode pair and the first conductive surface of the second electrode pair. A phase shifter is electrically coupled to the signal generator and is configured to generate a second periodic signal that is out of phase by a 180° phase shift with the first periodic signal and that is configured to apply the second periodic signal to the second conductive surface of the first electrode pair and the second conductive surface of the second electrode pair. Ions that are introduced into the gap are trapped by a resulting electric field. An ion detector is disposed relative to the gap so that ions exiting the ion trap will intersect a surface thereof. The ion detector is configured to generate a signal indicating detected ions.

In yet another aspect, the invention is a method of trapping ions, in which a first periodic signal is applied to a first conductive member of a first electrode pair and the first periodic signal is applied to a first conductive member of a second electrode pair. The first conductive member of the first electrode pair and the second conductive member of the second electrode pair are disposed along a common first plane. The first periodic signal is phase shifted by a predetermined phase shift so as to generate a second periodic signal. The second periodic signal is applied a second conductive member of the first electrode pair and the second periodic signal is applied to a second conductive member of the second electrode pair. The second conductive member of the first electrode pair and the first conductive member of the second electrode pair are disposed along a common second plane that is parallel to and spaced apart from the first plane. The first electrode pair is spaced apart at a predetermined distance from the second electrode pair so as to form a gap therebetween. Ions are introduced into, or produced in, the gap. A selected type of ions is trapped by an electric field resulting from application of the first periodic signal to the first conductive members and application of the second periodic signal to the second conductive members. The selected type of ions is determined as a function of the predetermined distance between the first electrode pair and the second electrode pair.

These and other aspects of the invention will become apparent from the following description of the preferred embodiments taken in conjunction with the following drawings. As would be obvious to one skilled in the art, many variations and modifications of the invention may be effected without departing from the spirit and scope of the novel concepts of the disclosure.

DETAILED DESCRIPTION OF THE INVENTION

Figure 1A:
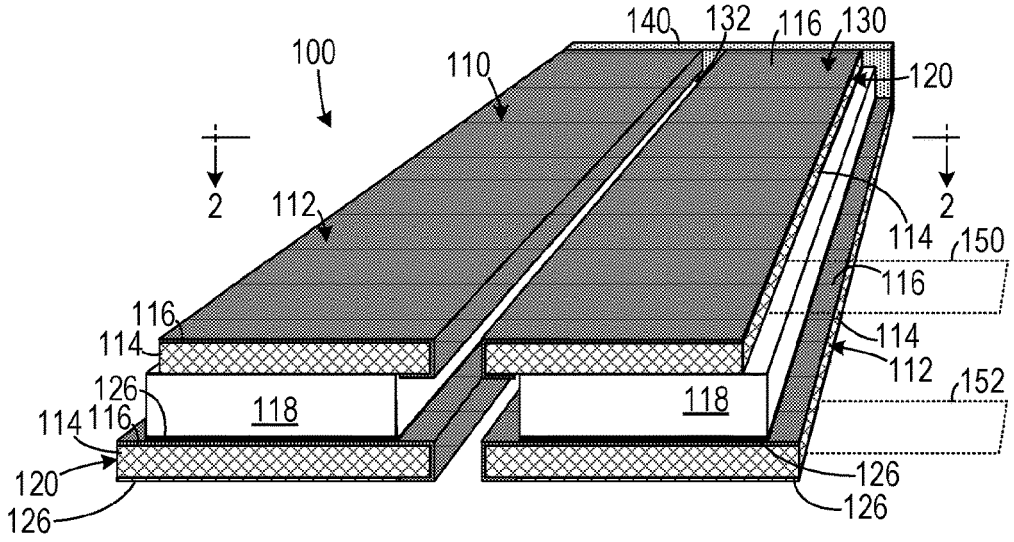
FIG. 1A is a perspective schematic diagram of one embodiment of a quadrupole ion trap for a mass analyzer.

A preferred embodiment of the invention is now described in detail. Referring to the drawings, like numbers indicate like parts throughout the views. Unless otherwise specifically indicated in the disclosure that follows, the drawings are not necessarily drawn to scale. The present disclosure should in no way be limited to the exemplary implementations and techniques illustrated in the drawings and described below. As used in the description herein and throughout the claims, the following terms take the meanings explicitly associated herein, unless the context clearly dictates otherwise: the meaning of "a," "an," and "the" includes plural reference, the meaning of "in" includes "in" and "on."

Figure 1B:
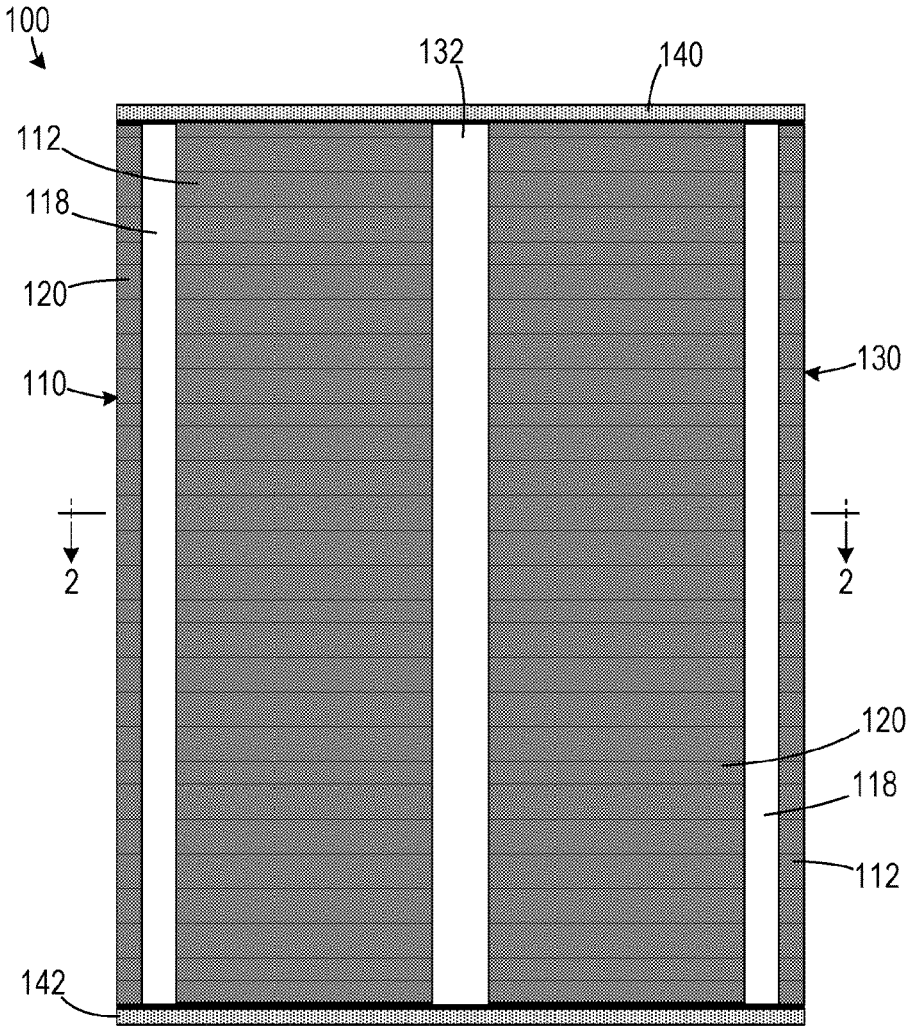
FIG. 1B is a top plan view of the embodiment shown in FIG. 1A.

As shown in FIGS. 1A and 1B, one embodiment of an ion trap 100 includes a first electrode pair 110 and a second electrode pair 130. Each electrode pair includes a first conductive member 112, a second conductive member 120 and a spacer 118 disposed therebetween. In certain embodiments, the first conductive member 112 and the second conductive member 120 can comprise metal plates. In one embodiment, the spacer 118 includes a grounded conductive material, such as a metal. Each of the first conductive member 112 and the second conductive member 120 can include a non-conductive prismatic plate 114 made of a non-conductive material such as alumina, or other inorganic crystalline substance that is partially covered with a conductive coating 116, such as a gold film. In a chip-scale embodiment, gold could be applied to a portion of an alumina plate through sputtering, or a similar process, to form a conductive member. The ion trap 100 could also be mounted on a substrate (not shown). (Many other metals and conductive materials other than gold may be suitable, depending upon the specific application.) A thin insulative layer 126 can be used to separate conductive members. A first conductive end cap 140 and a second conductive end cap 142 (which was left out of FIG. 1A to allow viewing of the other components) can be used to further trap ions. A hole 144 for allowing axial entry and escape of ions can be defined in the end cap electrodes 140, 142. The first electrode pair 110 and a second electrode pair 130, (also referred to as "RF electrodes" as they are powered by a radio frequency signal) confine ions radially. The additional end cap electrodes 140, 142 can be biased with a DC voltage so as to confine the ions axially. The endcaps can also be grounded and an appropriate DC voltage added to the RF electrodes to lead to axial confinement of the ions. (In alternative embodiments, the end cap electrodes 140, 142 can be powered by an additional RF signal to further manipulate ions.)

The first electrode pair 110 faces the second electrode pair 130 so that the first conductive member 112 of the first electrode pair 110 is on a first common plane 150 with the second conductive member 120 of the second electrode pair 130. Also, the second conductive member 120 of the first electrode pair 110 is on a second common plane 152 with the first conductive member 112 of the second electrode pair 130. (The first common plane 150 and the second common plane 152 are shown in broken lines to demonstrate the dispositions of the conductive members and are not tangible physical objects.) The first common plane 150 is spaced apart from and parallel to the second common plane 152. The first electrode pair 110 is separated from the second electrode pair 130 by a gap 132. The width of the gap 132 and the height of the spacer 118 determines the type of electric field within the ion trap 100 and, thus, the mass-to-charge ratio of the ions that will be trapped therein. The length of the gap 132 determines the overall ion capacity of the ion trap 100.

Figure 2:
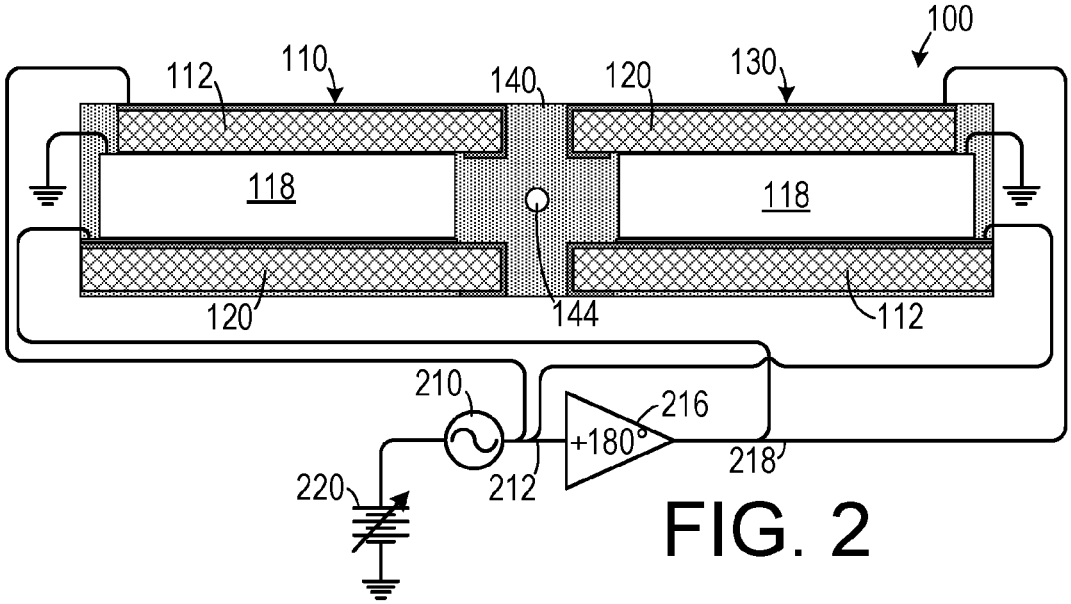
FIG. 2 is a cross-sectional view of the embodiment shown in FIGS. 1A and 1B, taken along line 2-2, with added electrical devices.

As shown in FIG. 2, a signal generator generates 210 a first periodic signal 212, such as a radio frequency sine wave (other waveforms, such as square waves, etc., can be used in certain embodiments), which is applied to the first conductive members 212 of each electrode pair 110 and 113. A phase shifter 216 generates a second periodic signal 218 that is a phase-shifted version of the first periodic signal 212 and is typically out of phase therefrom by 180° (although other phase relationships may be used in certain applications). The second periodic signal 218 is applied to the second conductive members 120 of each electrode pair 110 and 113. This results in a dynamic electric field that tends to trap ions of a mass-to-charge ratio determined by the dimensions of the device, and the frequency and amplitude of the output of the signal generator 210. The periodic signals 212 and 218 can be biased with a ramped-up variable voltage such as with a saw-tooth waveform generator 220 or a DC bias voltage. It has been found that different ion types tend to escape the ion trap 100 at a predetermined bias voltage and, therefore, correlating detected ions to a specific bias voltage (or frequency in certain dynamic frequency embodiments) in a ramped-up voltage can be used to identify a specific type of ion.

It should be noted that other modes of mass analysis are possible. For example, instead of ramping the voltage up, the frequency can be ramped down (also, the ramps don't need to be linear in time). One alternate embodiment can employ additional RF signals to resonantly excite the ions to the point where they are ejected from the ion trap. While there are many methods of mass analysis that can be employed with the structure disclosed here, with proper selection of the vertical and horizontal spacing, the resulting fields can obtain better than unit mass resolution.

In one alternate embodiment, this structure can function as an ion trap by grounding the second conductive members of each electrode pair and putting RF on only the first members. The equation we included then just changes by adding a factor of two and, thus, the voltage in this configuration would be two times higher. However, such a trap might not be used in a mass analyzer then due to poorer resolution and poorer ejection efficiency.

Figure 3:
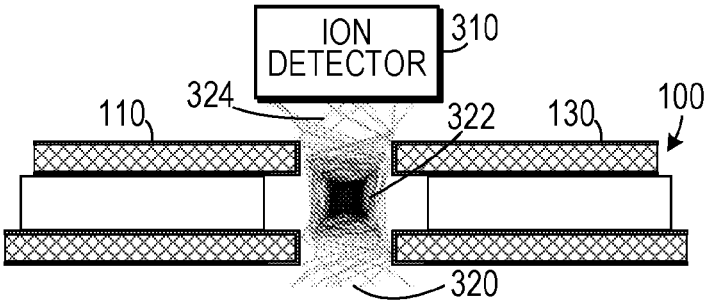
FIG. 3 is a schematic diagram of an ion trap mass analyzer system showing simulated ion trajectories.

As shown in FIG. 3, in a graphical simulation that includes a map of ion trajectories, the ion trap 100 can receive ions from an ion source 320 (e.g., of a type generally known in the mass analyzer art). The fields generated therein correspond closely to those of an ideal quadrupole ion trap. While most ions 322 are trapped by the electric field generated in the gap by the first electrode pair 110 and the second electrode pair 130, certain species of ions 324 can be ejected from the ion trap 100 in a mass specific way and be detected by an ion detector 310. Also, relatively few ions terminate on the surfaces of the ion trap 100 and escape through the gap instead. The specific species detected at any given time can be determined by correlating the detection time with the corresponding values of the trap parameters (i.e. in the ramped-up biasing voltage, ramped-down biasing frequency or the frequency of an additionally applied resonantly exciting signal) at the time of detection.

Figure 4A:
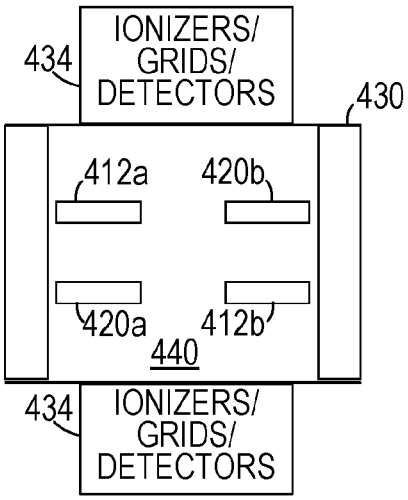
FIGS. 4A and 4B are schematic diagrams of one experimental embodiment of a quadrupole ion trap.
Figure 4B:
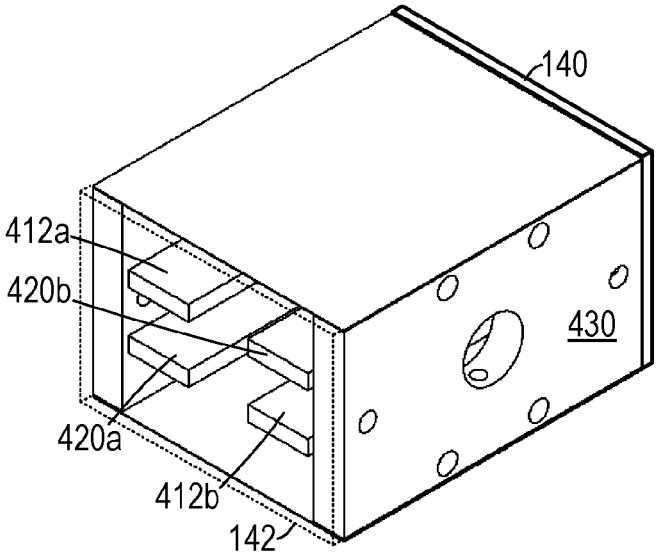

One macro-scale experimental embodiment, as shown in FIGS. 4A and 4B, includes a first conductive prismatic rod 412*a* and a spaced-apart second conductive prismatic rod 420*a* as part of a first electrode pair and a first conductive prismatic rod 412*b* and a spaced-apart second conductive prismatic rod 420*b* as part of a second electrode pair. The four rods form the trap (i.e. with applied RF voltage) and confine the ions in the radial dimension. Two additional electrodes at both ends (only one end electrode 140 is shown for the sake of clarity) of the rods can be biased with a DC voltage (positive for positive ions, negative for negative ions) to confine the ions along the axial dimension. Ionizers, grids or detectors 434 can be placed at the top and bottom ends of the trap.

If the rectangular rods are surrounded by a grounded box 430 (which occurs in many embodiments because they are in a metal vacuum chamber), a DC bias can be added to the rods in additional to their RF voltages. A negative bias will lead to axial confinement of positive ions, and vice versa for negative ions. The trap can also be operated with square wave voltages to act as a digital ion trap. By changing the duty cycle of the square waves an average DC bias that also leads to axial confinement can be obtained. Other applied RF voltage waveforms (e.g. triangle wave) can also be used to trap and analyze ions.

Figure 5:
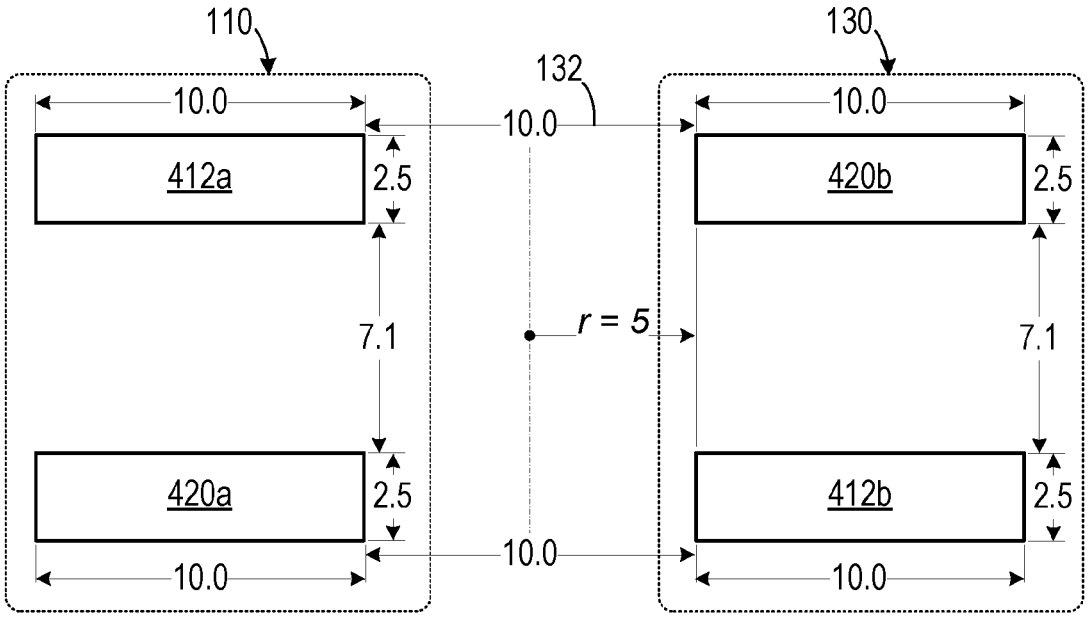
FIG. 5 is a schematic diagram of a quadrupole ion trap for a mass analyzer that shows dimensional relationships between the elements.

The ion trap can be scaled so long as the relative dimensions of the elements are maintained. Such dimensions for one experimental embodiment are shown in FIG. 5, in which each conductive member is a prismatic rod (412*a*, 420*a*, 412*b* and 420*b*) with a conductive surface, as described above, that has a thickness of 2.5 units and a width of 10.0 units. The prismatic rod 412*a* of the first electrode pair 110 is spaced apart from the prismatic rod 420*a* of the first electrode pair 110 at a distance in a range of 6.0 units to 8.2 units. Similarly, the prismatic rod 412*b* of the second electrode pair 130 is spaced apart from the prismatic rod 420*b* of the second electrode pair 130 at a distance in a range of 6.0 units to 8.2 units. The gap 132 defined between the first electrode pair 110 and the second electrode pair 130 is 10.0 units (yielding an effective trap field radius of approximately 5.0 units). When scaling the ion trap, if these dimensional relationships are maintained, then the formula for the voltage and frequency at which an ion becomes unstable for quadrupole ion traps and, thus, would be likely to exit the ion trap through the gap 132 is as follows:

$$\frac{2V}{\left(\frac{m}{Z}\right)r^2\Omega^2} = 0.9$$

Where:

m is the ion mass z is the ion charge r is the effective trap radius (approximately 5 mm for the trap used with the experimental embodiment)

Omega (Ω)=2*π*f, where f is the RF drive frequency

V is the applied RF voltage amplitude.

In one experimental embodiment (in which the units were mm), each rod was 2.5 mm thick, 10 mm wide and about 50 mm long. The rods of each electrode pair were spaced apart from each other at a distance of 7.1 mm and the gap between the electrode pairs was 10.0 mm. In this experimental embodiment, the RF drive frequency was about 1 MHz, and the ramped-up biasing voltage amplitude went from about 30 V to about 300 V. Employing these parameters, the experimental embodiment was able trap and analyze ions from about 6 amu up to 60 amu. Thus, in this experimental embodiment, dropping the frequency a factor of 2 would make the mass range 26-260 amu. And if one used 50V-500V at that frequency the mass range would be about 43-430 amu.

The present ion trap can be used in a linear quadrupole ion trap mass analyzer, which simulations and experiments so far performed have indicated can provide better than unit mass resolution and high detection efficiency, thus enabling useful mass analysis with a micron-scale device that can be microfabricated with well-established techniques. The ion trap produces a highly quadrupolar potential despite the use of flat, rectangular shaped electrodes. By putting the linear ion trap on a chip, it is possible to have separate regions of the chip where the ions are created, analyzed and detected as the ions can be moved through different regions with the use of additional DC voltages.

Simulations to determine specific dimensions and other operating parameters can be performed using software to calculate electric fields and the trajectories of charged particles in those fields when given a configuration of electrodes with applied time-varying voltages and particle initial conditions. One example of such a software package is SIMION® (available through https://simion.com/). If the thickness of the rods changes sufficiently, the optimal vertical to horizontal spacing of the electrodes can change.

A chip scale linear quadrupole ion trap of the type disclosed herein simultaneously confines a large range of particles with varying m/z (mass-to-charge ratio) values and then ejects them from the trap in a m/z specific way so that they can be detected. An advantage of this device is that its geometry enables sub-unit mass resolution even though the electrode shapes are non-hyperbolic and flat. While other flat electrode devices often produce major electric field deviations from the desired quadrupolar potential that enables mass analysis, the geometry of the present ion trap produces a sufficiently quadrupolar potential that allows sub-unit resolution in mass analyzing systems.

It is estimated that the present ion trap can result in about three times the mass resolution of similar systems employing flat electrode surfaces (e.g. an existing rectilinear ion trap. Additionally, it can produce a three times higher ion ejection/detection efficiency as that of similar systems. If manufactured at the chip scale, it can be made small and low weight at a low per-unit cost. These features would enable them to be deployed while mounted on small vehicles and war fighters, etc., and in large networked arrays.

The applications for mass analyzers employing linear quadrupole ion trap as disclosed herein can include:

- Environmental analysis—detection of chemical and biological weapons, explosives, toxic industrial chemicals, pollution monitoring, ocean studies, soil contamination, trace elemental analysis, air quality measurements, food processing, drinking water;
- Clinical/Pharmaceutical/Biological analysis—Drug development, cancer/disease screening, biomarkers, infectious agents, characterization of protein complexes, peptide sequencing; and
- Forensic analysis—trace evidence, arson investigations, identification of explosive residues, illicit drugs.

Figure 6:
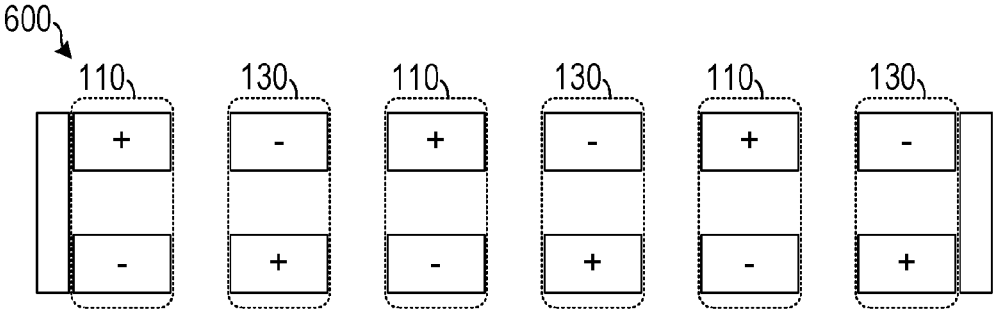
FIG. 6 is a schematic diagram of an array of electrode pairs.

In certain embodiments, as shown in FIG. 6, it is possible to incorporate a plurality of first electrode pairs 110 and second electrode pairs 130 as an array 600 as part of a plurality of traps/analyzers in a single instrument or on a single chip. Such an array 600 can be configured so that several different species of ions could be detected with a single instrument or chip.

Figure 7A:
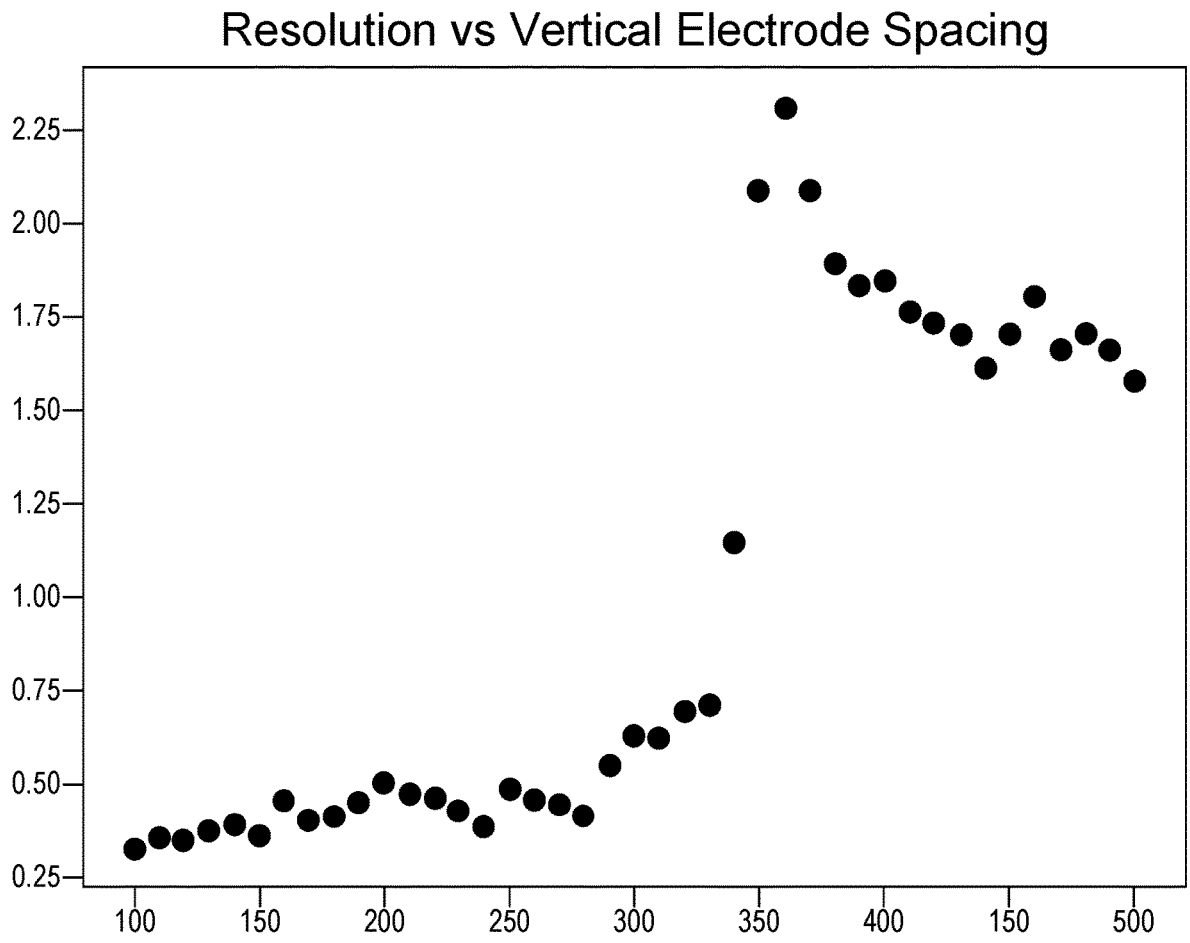
FIGS. 7A and 7B are charts showing results of simulations relating parameters to vertical electrode spacing.
Figure 7B:
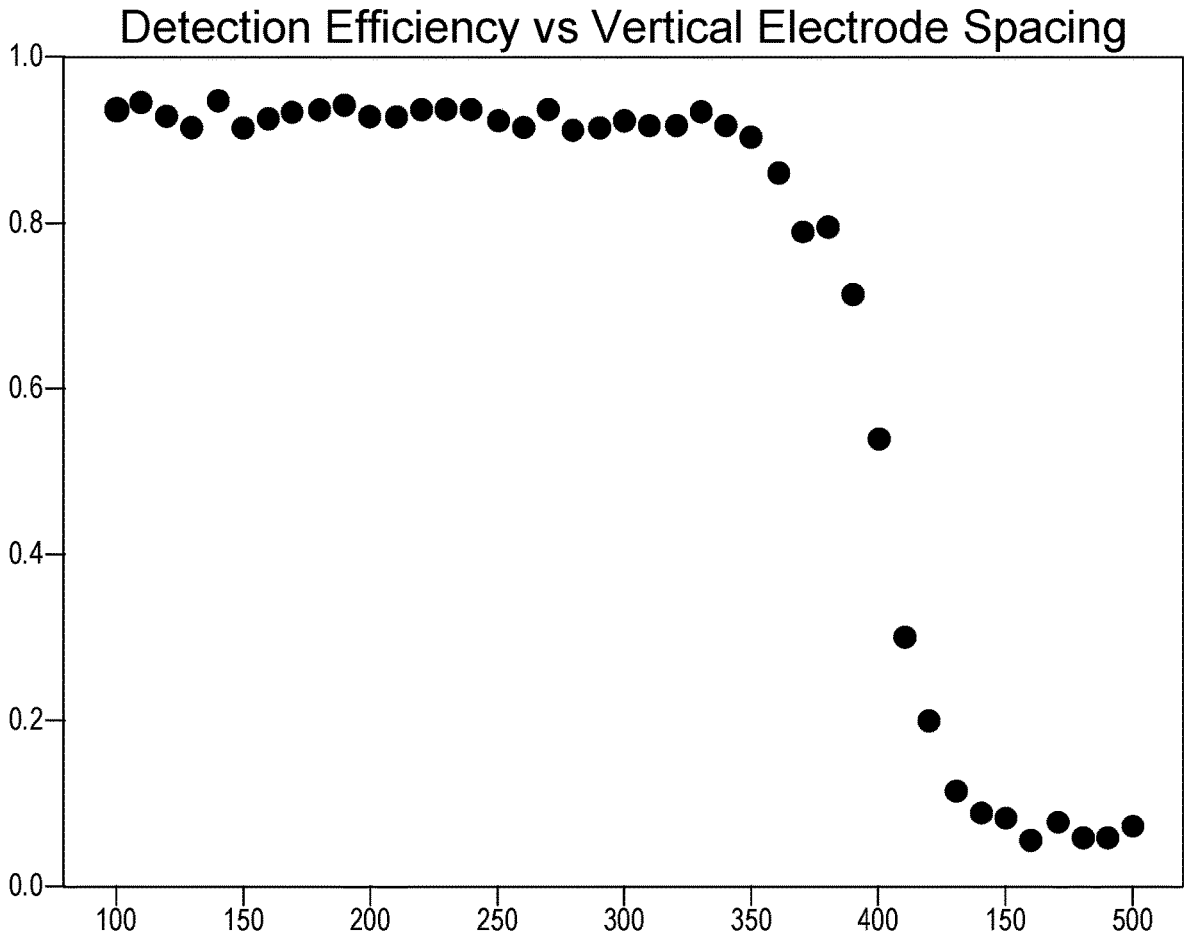

As shown in FIG. 7A one simulation was performed to determine a proper vertical spacing for RF electrodes of a given thickness and horizontal spacing. This figure shows the resolution as a function of vertical spacing (in which a higher resolution is considered better). The horizontal axis shows the resulting resolution for a vertical spacing divided by two, for an electrode thickness of 200-250 microns (nothing in this range leads to a significant change in the optimal vertical spacing), and a horizontal spacing of 1000 microns. In this simulation, the points at 350, 360 and 370 microns led to the highest resolution of any spacing. So, in this simulation, the optimal vertical spacing should be 700-740 microns to make an effective mass analyzer. Also, as shown in FIG. 7B, this simulation indicates the number of ions that are ejected from the trap (and can thus be detected to produce signal) in which 1 corresponds to 100% and 0 corresponds to 0%. Greater than 75% for the points that show maximal resolution, thus also yielding high detection efficiency at the points of highest resolution.

Although specific advantages have been enumerated above, various embodiments may include some, none, or all of the enumerated advantages. Other technical advantages may become readily apparent to one of ordinary skill in the art after review of the following figures and description. It is understood that, although exemplary embodiments are illustrated in the figures and described below, the principles of the present disclosure may be implemented using any number of techniques, whether currently known or not. Modifications, additions, or omissions may be made to the systems, apparatuses, and methods described herein without departing from the scope of the invention. The components of the systems and apparatuses may be integrated or separated. The operations of the systems and apparatuses disclosed herein may be performed by more, fewer, or other components and the methods described may include more, fewer, or other steps. Additionally, steps may be performed in any suitable order. As used in this document, "each" refers to each member of a set or each member of a subset of a set. It is intended that the claims and claim elements recited below do not invoke 35 U.S.C. § 112(f) unless the words "means for" or "step for" are explicitly used in the particular claim. The above described embodiments, while including the preferred embodiment and the best mode of the invention known to the inventor at the time of filing, are given as illustrative examples only. It will be readily appreciated that many deviations may be made from the specific embodiments disclosed in this specification without departing from the spirit and scope of the invention. Accordingly, the scope of the invention is to be determined by the claims below rather than being limited to the specifically described embodiments above.

What is claimed is:

1. An ion trap for a mass analyzer, comprising:

(a) a first electrode pair and a second electrode pair, each electrode pair including:

(i) a first conductive member;

(ii) a second conductive member, the first electrode pair facing the second electrode pair so that the first conductive member of the first electrode pair is on a first common plane with the second conductive member of the second electrode pair and so that the second conductive member of the first electrode pair is on a second common plane with the first conductive member of the second electrode pair, the first common plane spaced apart from and parallel to the second common plane, the first electrode pair spaced apart from the second electrode pair so as to define a gap therebetween;

(b) a signal generator that is configured to generate a first periodic signal and to apply the first periodic signal to the first conductive member of the first electrode pair and the first conductive member of the second electrode pair; and (c) a phase shifter electrically coupled to the signal generator and configured to generate a second periodic signal that is out of phase by a predetermined phase shift with the first periodic signal and to apply the second periodic signal to the second conductive member of the first electrode pair and the second conductive member of the second electrode pair, so that ions of a predetermined type that are introduced into the gap are trapped by a resulting electric field, wherein the ion trap has relative dimensions including: a space in a range of 6.0 units to 8.2 units defined between the first conductive member of the first electrode pair and the second conductive member of the first electrode pair; a space in a range of 6.0 units to 8.2 units defined between the first conductive member of the second electrode pair and the second conductive member of the second electrode pair; and the first electrode pair is spaced apart from the second electrode pair so as to define a space therebetween of about 10 units; and wherein ions escaping through the gap have an ion mass and an ion charge and the signal generator is configured to generate the first periodic signal so as to have an RF drive frequency and an RF voltage amplitude determined by:

$$\frac{2V}{\left(\frac{m}{Z}\right)r^2\Omega^2} = 0.9$$

wherein:

m is the ion mass;

z is the ion charge;

r is an effective trap radius, which is approximately one half of the space between the first electrode pair and the second electrode pair;

Omega (Ω)=2*π*f, where f is the RF drive frequency; and

V is the applied RF voltage amplitude, the voltage at which an ion of mass m and charge z is ejected from the ion trap, wherein values of voltage below V result in an ion to be trapped stably.

2. The ion trap of claim 1, wherein the signal generator is further configured to apply a ramped bias signal to the first periodic signal before the phase shifter.

3. The ion trap of claim 1, wherein the predetermined phase shift is 180°.

4. The ion trap of claim 1, wherein each electrode pair further comprises a spacer having a first planar surface and an opposite second planar surface, and disposed between the first conductive member and the second conductive member.

5. The ion trap of claim 4, wherein the spacer comprises a conductive material and is grounded.

6. The ion trap of claim 1, wherein each first conductive member and each second conductive member comprises:

(a) a plate that includes a non-conductive material; and (b) a coating of a conductive material covering a portion of the non-conductive plate.

7. The ion trap of claim 6, wherein the non-conductive material comprises an inorganic crystalline substance.

8. The ion trap of claim 7, wherein the inorganic crystalline substance comprises alumina.

9. The ion trap of claim 6, wherein the conductive material comprises a gold film.

10. The ion trap of claim 1, wherein the first periodic signal comprises a radio-frequency signal.

11. The ion trap of claim 1, employed in a mass analyzer.

12. A quadrupole ion trap mass analyzer, comprising:

(a) an ion source;

(b) an ion trap that includes a first electrode pair and a second electrode pair, each electrode pair including:

(i) a first conductive member including a first conductive surface;

(ii) a second conductive member including a second conductive surface; and (iii) a grounded conductive spacer disposed between the first conductive member and the second conductive member, the first electrode pair facing the second electrode pair so that the first conductive surface of the first electrode pair is on a first common plane with the second conductive surface of the second electrode pair and so that the second conductive surface of the first electrode pair is on a second common plane with the first conductive surface of the second electrode pair, the first common plane spaced apart from and parallel with the second common plane, the first electrode pair spaced apart from the second electrode pair so as to define a gap therebetween, each first conductive member and each second conductive member including: a plate that includes a non-conductive material; and a coating of a conductive material covering a portion of the non-conductive plate, wherein the non-conductive material comprises alumina;

(c) a signal generator that is configured to generate a first periodic radio frequency signal that is biased by an alterable bias signal and to apply the first periodic signal to the first conductive surface of the first electrode pair and the first conductive surface of the second electrode pair; and (d) a phase shifter electrically coupled to the signal generator and configured to generate a second periodic signal that is out of phase by a 180° phase shift with the first periodic signal and to apply the second periodic signal to the second conductive surface of the first electrode pair and the second conductive surface of the second electrode pair, wherein ions that are introduced into the gap are trapped by a resulting electric field; and (e) an ion detector that is disposed relative to the gap so that ions exiting the ion trap will intersect a surface thereof, the ion detector configured to generate a signal indicating detected ions.

13. The quadrupole ion trap mass analyzer of claim 12, wherein the ion trap has relevant dimensions including: a space in a range of 6.0 units to 8.2 units defined between the first conductive member of the first electrode pair and the second conductive member of the first electrode pair; a space in a range of 6.0 units to 8.2 units defined between the first conductive member of the second electrode pair and the second conductive member of the second electrode pair; and the first electrode pair is spaced apart from the second electrode pair so as to define a space therebetween of about 10 units; and wherein ions escaping through the gap have an ion mass and an ion charge and the signal generator is configured to generate the first periodic signal so as to have an RF drive frequency and an RF voltage amplitude determined by:

$$\frac{2V}{\left(\frac{m}{Z}\right)r^2\Omega^2} = 0.9$$

wherein:

m is the ion mass;

z is the ion charge;

r is effective trap radius, which is approximately one half of the space between the first electrode pair and the second electrode pair;

Omega (Ω)=2*π*f, where f is the RF drive frequency; and

V is the applied RF voltage amplitude, the voltage at which an ion of mass m and charge z is ejected from the ion trap, wherein values of voltage below V result in an ion to be trapped stably.

14. The quadrupole ion trap mass analyzer of claim 12, wherein the conductive material comprises a gold film.

15. The quadrupole ion trap mass analyzer of claim 12, wherein the first conductive members and the second conductive members are separated by a vertical distance relative to the width of the gap defined between the first electrode pair and the second electrode pair that yields optimal resolution.

16. A method of trapping ions, comprising the steps of:

(a) applying a first periodic signal to a first conductive member of a first electrode pair and applying the first periodic signal to a first conductive member of a second electrode pair, wherein the first conductive member of the first electrode pair and the second conductive member of the second electrode pair are disposed along a common first plane;

(b) phase shifting the first periodic signal by a predetermined phase shift so as to generate a second periodic signal;

(c) applying the second periodic signal a second conductive member of the first electrode pair and the second periodic signal to a second conductive member of the second electrode pair, wherein the second conductive member of the first electrode pair and the first conductive member of the second electrode pair are disposed along a common second plane that is parallel to and spaced apart from the first plane;

(d) spacing the first electrode pair at a predetermined distance from the second electrode pair so as to form a gap therebetween;

(e) introducing ions into the gap, a selected type of which are trapped by an electric field resulting from application of the first periodic signal to the first conductive members and application of the second periodic signal to the second conductive members; and (f) determining dimensions wherein ions escaping through the gap have an ion mass and an ion charge and the signal generator is configured to generate the first periodic signal so as to have an RF drive frequency and an RF voltage amplitude determined by:

$$\frac{2V}{\left(\frac{m}{Z}\right)r^2\Omega^2} = 0.9$$

wherein:

m is the ion mass;

z is the ion charge;

r is effective trap radius, which is approximately one half of the predetermined distance between the first electrode pair and the second electrode pair;

Omega (Ω)=2*π*f, where f is the RF drive frequency; and

V is the applied RF voltage amplitude.

17. The method of claim 16, further comprising the step of relatively spacing the first conductive members and the second conductive members so that a space in a range of 6.0 units to 8.2 units is defined between the first conductive member of the first electrode pair and the second conductive member of the first electrode pair; a space in a range of 6.0 units to 8.2 units is defined between the first conductive member of the second electrode pair and the second conductive member of the second electrode pair; and the first electrode pair is spaced apart from the second electrode pair so as to define a space therebetween of about 10 units.

18. The method of claim 16, further comprising the step of applying a ramped bias signal to the first periodic signal prior to the phase shifting step.

19. The method of claim 16, wherein the predetermined phase shift is 180°.

20. The method of claim 16, further comprising the step of separating the first conductive member from the second conductive member of each electrode pair with a conductive spacer that is grounded.

* * * * *